US012181157B2

(12) United States Patent
Flesch et al.

(10) Patent No.: US 12,181,157 B2
(45) Date of Patent: Dec. 31, 2024

(54) COMBINATION APPLIANCE COMPRISING A FUME EXTRACTION DEVICE AND A HOB

(71) Applicant: BSH Hausgeräte GmbH, Munich (DE)

(72) Inventors: Sebastien Flesch, Gerstheim (FR); Guillaume Laurent, Bischoffsheim (FR)

(73) Assignee: BSH Hausgeräte GmbH, Munich (DE)

( * ) Notice: Subject to any disclaimer, the term of this patent is extended or adjusted under 35 U.S.C. 154(b) by 515 days.

(21) Appl. No.: 17/601,721

(22) PCT Filed: Apr. 9, 2020

(86) PCT No.: PCT/EP2020/060225
§ 371 (c)(1),
(2) Date: Oct. 6, 2021

(87) PCT Pub. No.: WO2020/212261
PCT Pub. Date: Oct. 22, 2020

(65) Prior Publication Data

US 2022/0178552 A1 Jun. 9, 2022

(30) Foreign Application Priority Data

Apr. 17, 2019 (EP) ..... 19290026

(51) Int. Cl.
*F24C 15/20* (2006.01)

(52) U.S. Cl.
CPC ..... *F24C 15/2042* (2013.01); *F24C 15/2021* (2013.01); *F24C 15/2035* (2013.01)

(58) Field of Classification Search
CPC .. F24C 15/2021; F24C 15/20; F24C 15/2035; F24C 15/2042
(Continued)

(56) References Cited

U.S. PATENT DOCUMENTS 3,690,245 A * 9/1972 Ferlise ..... F24C 15/2021 126/299 D
4,457,293 A * 7/1984 Berlik ..... F24C 15/2042 126/39 M
(Continued)

FOREIGN PATENT DOCUMENTS

DE 202013005303 U1 6/2013
DE 102018215480 A1 4/2019
(Continued)

OTHER PUBLICATIONS

EP3457033A1 Machine Translation.*
International Search Report PCT/EP2020/060225 dated Jun. 12, 2020.

*Primary Examiner* — Vivek K Shirsat
(74) *Attorney, Agent, or Firm* — Michael E. Tschupp; Andre Pallapies; Brandon G. Braun

(57) ABSTRACT

A combination appliance includes a hob including a cooking module and having a suction opening, and a fume extraction device located, at least in part, below the cooking module. The fume extraction device includes a blower located below the suction opening and having an air inlet opening, and a filter unit located at the suction opening and having a grease filter. The fume extraction device includes a separating plate which separates the filter unit from the blower located below the filter unit.

19 Claims, 5 Drawing Sheets

(58) Field of Classification Search
USPC ..... 126/299 D, 299 R, 299 F, 300
See application file for complete search history.

(56) References Cited

U.S. PATENT DOCUMENTS

| | | | | |
|---|---|---|---|---|
| 2020/0333018 | A1 | 10/2020 | Goessler | |
| 2021/0197112 | A1* | 7/2021 | Barry | B01D 46/521 |

FOREIGN PATENT DOCUMENTS

| | | | |
|---|---|---|---|
| EP | 3136004 | A1 | 3/2017 |
| EP | 3457033 | A1 * | 9/2018 |

* cited by examiner

COMBINATION APPLIANCE COMPRISING A FUME EXTRACTION DEVICE AND A HOB

CROSS-REFERENCES TO RELATED APPLICATIONS

This application is the U.S. National Stage of International Application No. PCT/EP2020/060225, filed Apr. 9, 2020, which designated the United States and has been published as International Publication No. WO 2020/212261 A1 and which claims the priority of European Patent Application, Ser. No. 19290026.4, filed Apr. 17, 2019, pursuant to 35 U.S.C. 119 (a)-(d).

The contents of International Application No. PCT/EP2020/060225 and European Patent Application, Ser. No. 19290026.4 are incorporated herein by reference in their entireties as if fully set forth herein.

BACKGROUND OF THE INVENTION

The present invention relates to a combination appliance comprising a fume extraction device and a hob.

Fumes and vapors are generally produced during cooking processes. Fume extraction devices are known, the fumes and vapors being able to be suctioned and cleaned thereby. To this end, combination appliances are known, for example, in which a fume extraction device is arranged below the hob. Such a combination appliance is disclosed, for example, in DE 20 2013 005 303 U1. In this combination appliance, a housing for the heating or hob heating electronics and the control electronics is provided on the underside of the hob. A fan housing for two or more radial fans, which suction the air upwardly from a cooking fume suction chamber located therebelow, is arranged below the housing.

This embodiment has the disadvantage that the installation space which is available below the hob and which is required, for example, for the blower and for filters is reduced due to the arrangement of the housing for the electronics.

BRIEF SUMMARY OF THE INVENTION

It is the object of the present invention, therefore, to create a combination appliance which has a compact construction and yet has a high degree of efficiency when suctioning and filtering the fumes and vapors.

The object is achieved, therefore, by a combination appliance which has a hob with at least one cooking module and a fume extraction device, at least part of which is located below the at least one cooking module and which has a blower having at least one air inlet opening and a filter unit, and a suction opening for the fume extraction device, said suction opening being located in the hob. The combination appliance is characterized in that the blower is located below the suction opening, the filter unit is located at the suction opening, and the fume extraction device has a separating plate which separates the filter unit from the blower located below same.

Directional information, such as for example above and below as well as front and rear, unless indicated otherwise, refer to the combination appliance and the components thereof in an installed state in which the hob and, in particular, the at least one cooking module are located in the horizontal direction. The side which faces the user is denoted as the front side. The rear side is the side which generally faces an assembly wall. Additionally, the rear side of the combination appliance is preferably the side via which cleaned air is discharged from the combination appliance. The dimension in the direction between the front side and the rear side is denoted as the depth. The dimension perpendicular thereto in the horizontal direction is denoted as the width. The dimension in the vertical direction is denoted as the height.

A household appliance in which a hob and a fume extraction device are combined together is denoted as a combination appliance. In particular, a household appliance which may be installed as an assembly unit in a kitchen is denoted as a combination appliance. Preferably the two components of the combination appliance, i.e. the hob and the fume extraction device, are supplied by a common power supply, for example a common power cable. Additionally, the control of the two components may be carried out by a common control device in which the control devices for the two components are combined. For example, the two components may also be operated by a common operating unit which may also be denoted as a user interface.

The combination appliance comprises a hob, a fume extraction device as well as a suction opening for the fume extraction device. The hob has at least one cooking module. Additionally, the hob preferably has a cover plate on which the cooking module or the cooking modules are arranged from below. The cover plate may consist, for example, of ceramic. At least one cooking zone is formed by each of the cooking modules, i.e. a region on which food to be cooked may be heated on the hob. The cooking module may represent an electrical heating module with a heating coil. The cooking module, however, preferably represents an induction module and is also denoted as an inductor. The induction module preferably comprises at least one induction coil. An induction module is understood to mean, in particular, a component which is provided, by converting electrical energy, to generate a alternating magnetic field, which serves to generate eddy currents and/or demagnetizing effects which are converted into heat in an at least partially ferromagnetic cooking vessel, for example a pot. Preferably at least two cooking modules are provided in the hob of the combination appliance according to the invention. However, more cooking modules, for example four or six, may also be provided. A cooking zone is formed by each cooking module.

The combination appliance also comprises a fume extraction device. A device by means of which air, in particular contaminated air, for example in the form of fumes and vapors, may be suctioned downwardly from the space above the hob is denoted as a fume extraction device. In the fume extraction device the air is cleaned and discharged as cleaned air or, respectively, clean air from the fume extraction device and the combination appliance. To this end the fume extraction device comprises a blower.

The fume extraction device comprises a blower. A blower in this case is understood to mean a unit consisting of a fan, in particular a fan wheel, and a blower housing surrounding the fan. The fan preferably represents a radial fan, in particular a radial fan with blades curved toward the front, and the blower housing preferably represents a spiral housing which may also be denoted as a worm housing.

The fume extraction device is arranged at least partially below the at least one cooking module. In particular, the at least one blower is arranged downwardly offset relative to the cooking module or the cooking modules.

The blower has at least one air inlet opening. Additionally, the blower has an air outlet opening on the blower housing. The air inlet opening is incorporated in the blower housing, or, respectively, is formed thereby and represents the opening via which air may be suctioned through the fan into the blower housing. The air inlet opening in this case is located perpendicular to the rotational axis of the fan wheel.

The blower according to the invention is located below the suction opening. In particular, the blower is arranged below the suction opening such that the air inlet opening of the blower faces the suction opening. The rotational axis of the fan wheel in this case is preferably located in the center of the suction opening, i.e. in the projection perpendicular to the suction opening in the center of the surface of the suction opening.

The combination appliance has a suction opening of the fume extraction device. The opening via which air enters from above the hob into the combination appliance is denoted as the suction opening. The suction opening for the fume extraction device is also denoted hereinafter as the suction opening of the fume extraction device. The suction opening is incorporated in the hob. In particular, the suction opening is arranged in a cut-out in the hob, in particular a cut-out in the cover plate. The suction opening may be located in the cut-out of the hob or formed thereby. In the first case, the air inlet opening may be formed, for example, by the upper edge of a filter unit which is arranged in the cut-out. The cooking modules of the hob are arranged offset relative to the cut-out of the hob.

The suction opening preferably represents an elongated gap or slot which extends in the depth direction of the hob. Preferably the suction opening is arranged in the center of the hob and, in particular, in the center of the cover plate of the hob. The width of the suction opening is less than or equal to the spacing of laterally adjacent cooking modules of the hob. The length of the suction opening in the depth direction may correspond to the depth of the hob. Preferably, however, the suction opening terminates at the rear end thereof with a spacing from the rear edge of the hob and at the front end thereof with a spacing from the front edge of the hob. Particularly preferably, the front end of the suction opening is located with a spacing from an operating part which is arranged in the front region of the hob and which is arranged in the center of the width or extends, for example, over the width of the hob.

The fume extraction device comprises a filter unit which comprises at least one grease filter. The grease filter may consist, for example, of expanded metal filter layers. Particularly preferably, the filter unit additionally comprises at least one odor filter. The filter unit is located at the suction opening. In particular, the filter unit is located below the suction opening and has a width which is greater than the width of the suction opening. By means of such a width of the filter unit the filter element or the filter elements, in particular the grease filter and odor filter, may be arranged such that they do not block the suction opening at the upper end thereof. As a result, the entry of air into the suction opening and thus into the filter unit is ensured.

The fume extraction device according to the invention has a separating plate which separates the filter unit from the blower located therebelow. The separating plate is preferably part of the filter unit and, in particular, forms the base of the filter unit. The separating plate consists of an air-impermeable material. Preferably, the separating plate consists of a material which is also impermeable to liquids. For example, the separating plate may consist of plastics. The separating plate is arranged such that it separates the filter unit from the blower located therebelow. In particular, the separating plate covers the air inlet opening of the blower upwardly. In this case a vertical spacing, which permits an airflow to the air inlet opening, is provided between the air inlet opening of the blower and the separating plate.

Since the blower is arranged below the suction opening, the filter unit is located at the suction opening and a separating plate is provided in the fume extraction device which separates the filter unit from the blower located therebelow, a series of advantages may be achieved. In particular, the space below the hob may be optimally used by the location of the blower below the suction opening and the location of the filter unit at the suction opening. In particular, the space below the cooking modules is free for further components of the combination appliance. Additionally, the flow path of the suctioned fumes and vapors to the filters of the filter unit is short. Finally, by means of the separating plate firstly an entry of liquids into the air inlet opening of the blower is prevented and secondly a targeted air guidance in the fume extraction device is ensured. The entry of liquids may occur by inadvertently spilling food to be cooked on the hob, wherein the liquid drips or runs into the suction opening. Additionally, liquid which has been separated on the filters of the filter unit may also drip downwardly. Since the blower is separated from the filter unit by the separating plate, the entry of this liquid into the air inlet opening of the blower may be prevented.

According to one embodiment, the separating plate has at least one recess. The recess may extend over the entire surface of the separating plate. In this case, the edge of the separating plate is formed, for example, by an upright material strip. Alternatively, the recess extends only over a part of the surface of the separating plate and is preferably provided in the center of the separating plate. A certain quantity of liquid may be held or collected on the separating plate by the recess in the separating plate. The recess may thus also be denoted as a collection container or collection channel. Preferably the recess of the separating plate is connected to a separate reservoir for receiving a greater quantity of liquid. In particular, the reservoir may be connected to an overflow of the recess.

According to one embodiment, the separating plate represents part of a housing for receiving the filter unit. The separating plate may form, in particular, the base of the housing. At least one of the side walls of the housing, in particular the longitudinal walls of an elongated housing, are preferably formed in this case by grilles. On the front faces, the housing may have air-impermeable walls. The housing may be fastened to the underside of the hob in the vicinity of the suction opening. Alternatively, the housing may be fastened via a fastening element in the suction opening. To this end, the fastening element may extend through the suction opening downwardly and run outwardly on the underside of the hob to the sides. As a result, it is possible to bridge the difference in width between the width of the suction opening and the width of the housing, which is preferably greater.

Since the separating plate is part of a housing, in particular the base of a housing, and at least one side wall of the housing represents a grille, firstly the entry of liquids into the blower may be prevented by the separating plate and secondly the separating plate may serve for holding at least one filter element of the filter unit. Additionally, the airflow to the air inlet opening of the blower is ensured by the at least one grille and secondly the grille may serve as a support for at least one filter element. Finally, by means of the grille and the separating plate the user is prevented from reaching from above into the interior of the combination appliance and, in particular, the blower.

According to one embodiment, at least one grease filter is arranged in an inclined manner in the filter unit. As a result, the filter surface of the grease filter may be increased to a small height and a targeted drainage of liquids along the grease filter may be ensured, in comparison with a horizontally oriented grease filter.

Particularly preferably, the grease filter has a V-shape, the open side thereof being oriented upwardly. The grease filter in this case may be configured in one piece or multiple pieces. In particular, a filter element may be bent or folded such that the V-shape is formed. Alternatively, the grease filter may consist of two filter elements, in each case one thereof forming a leg of the V-shape. The individual filter elements may be connected together indirectly or directly at the tip of the V-shape or may be separated from one another and thus may be removable separately from the filter unit. Since the grease filter has a V-shape, the filter surface may be maximized with a low height. Additionally, the angle of incident flow at which the air suctioned via the suction opening flows onto the grease filter is improved. In particular, a parallel incident flow, which would occur with vertically oriented grease filters, may be prevented.

According to a preferred embodiment, the V-shaped grease filter is designed to be foldable. This may be achieved in a one-piece grease filter by the choice of filter material. Alternatively, for example, with a one-piece filter element a weakening of the filter material may be incorporated at the tip of the V-shape which permits the folding and, in particular the folding up, of the filter element. With a two-part grease filter, the individual filter elements may be pivotably fastened to one another. This fastening may be direct or indirect. In particular, the filter elements may be connected together via a joint or via a connecting element to which each of the filter elements is pivotably fastened. Since the grease filter is foldable, after having been folded up this grease filter may be removed through the suction opening upwardly out of the fume extraction device and thus out of the combination appliance. The thickness of the grease filter is thus preferably less than or equal to the thickness of the suction opening. The length of the grease filter is preferably less than or equal to the length of the suction opening.

According to one embodiment, the underside of the grease filter is held in a collection container. The collection container may be, in particular, an upwardly open rail or hollow profile, for example a rectangular hollow profile, with a gap provided in the upper face. The grease filter is connected to the collection container, i.e. fastened thereto. Since a collection container which holds the grease filter on the underside and is connected thereto is provided, firstly liquid which drips from or runs down on the grease filter may be collected. Secondly, the grease filter may be removed together with the receptacle from the fume extraction device and cleaned. Finally, in the case of a two-part grease filter the receptacle may also serve as a connecting element, the two filter elements of the grease filter being foldably connected thereby. The width of the collection container is thus preferably less than or equal to the width of the suction opening. The length of the collection container is preferably less than or equal to the length of the suction opening. In the embodiment of the collection container as a rail, in each case an inwardly oriented web may be provided at the upper edges. As a result, or in the case of a hollow profile with a gap in the upper face, liquid collected in the collection container may be prevented from inadvertently escaping or overflowing when removed from the fume extraction device. The collection container preferably consists of a liquid-tight material, for example of plastics or metal. The collection container may be positioned on the separating plate of the fume extraction device. In the case of a separating plate which has a recess, the collection container may be placed on the recess or into the recess.

According to one embodiment, the filter unit has at least one odor filter which is arranged laterally adjacent to the at least one grease filter in the filter unit. The odor filter may take the form of a plate, mat or a shaped body and consist, for example, of activated carbon or have activated carbon or other odor-binding substances. Preferably the odor filter is arranged such that it is located in the direction of flow downstream of the grease filter. The odor filter in this case is located at the same height as the grease filter in the fume extraction device. As a result, the space requirement in the vertical direction is reduced. Additionally, in this arrangement the at least one odor filter is arranged in the direction of flow upstream of the blower. As a result, the odor filter may dampen the noises caused by the blower. The at least one odor filter is preferably releasably held in the filter unit. This means that the odor filter may be moved in the filter unit and may be removed therefrom. The odor filter may be positioned, for example, on the separating plate of the fume extraction device and applied to a wall of the housing which is formed by a grille. As a result, the odor filter is held downwardly and to one side in the housing. Since the odor filter is arranged laterally adjacent to the at least one grease filter and the grease filter is preferably located in a vertical projection of the suction opening in the surface of the suction opening, the odor filter is laterally offset outwardly relative to the suction opening below a cooking module. From this position, after removing the grease filter, the odor filter may be pulled in the direction of the suction opening and removed via said suction opening. The thickness of the odor filter is thus preferably less than or equal to the width of the suction opening and the length of the odor filter is preferably less than or equal to the length of the suction opening.

According to an alternative embodiment, the thickness of the odor filter is thus preferably less than or equal to the width of the suction opening but the length of the odor filter is longer than the length of the suction opening. In this embodiment, the odor filter is configured in multiple parts, i.e. it consists of a plurality of filter elements. Each of the filter elements of the odor filter in this case preferably has a length which is less than the length of the suction opening. In this embodiment, for example, a central filter element of the odor filter may be removed, and then a front filter element and then a rear filter element of the odor filter may be brought by displacement into a position in which the filter element is brought below the suction opening by pulling in the width direction of the fume extraction device relative to the suction opening and the filter element may be removed via this suction opening. The odor filter may thus consist, for example, of two, three or four filter elements which are not connected together.

According to one embodiment, the combination appliance has at least one hob electronics unit and at least one fume extraction device electronics unit and these electronics units are arranged laterally relative to the blower. The electronics units may have control and operating components as well as a mains power connection for the combination appliance. Power electronics are required for operating the hob and, in particular, the cooking module. The power electronics may in this case be used to supply the cooking module or the cooking modules with electrical energy. In this case the power electronics may convert the electrical energy, for example relative to the voltage waveform or the current. In this case the power electronics may comprise, for example, filter components and control electronics. The elements of the power electronics are, for example, rectifiers for rectifying the AC voltage of the household power supply system, inverters and switching devices, for example for power management. Power electronics are also required for operating the fume extraction device. Operating electrics are also required in order to operate the hob and the fume extraction device. Particularly preferably, in each case a hob electronics unit and a fume extraction device electronics unit are arranged on each side of the centrally arranged blower. Since the electronics units for the blower are arranged adjacently in the horizontal direction, the space requirement in the vertical direction is minimized. Since in each case the hob electronics unit and fume extraction device electronics unit are preferably arranged on each side, the effort for connecting the cooking modules is reduced. Additionally, the electronics required for the fume extraction device may be divided into two electronics units, wherein for example the control electronics may be separated from the operating electronics. The electronics units may have carriers on which the components are provided. Additionally, the electronics units may have in each case an electronics housing in which the components which are optionally fastened to carriers are received. Alternatively, the carriers with the components may be separated by one or more internal walls in an appliance housing of the combination appliance from the airflow in the fume extraction device.

Preferably, the hob electronics unit has a greater width than the fume extraction device electronics unit and the hob electronics unit is arranged above the fume extraction device electronics unit. By this arrangement, firstly the proximity of the hob electronics unit to the cooking modules of the hob may be ensured. Secondly the airflow from the filter unit which is arranged above the blower to the air inlet opening of the blower is optimized thereby. The electronics units are preferably arranged above the blower. By means of this arrangement, the blower may have a size which corresponds to the size of the hob. The spacing which is present between the upper side of the blower and the hob may serve in this case for receiving the filter unit and the electronics units arranged offset laterally thereto. Thus the combination appliance has a very compact construction but ensures an optimal airflow from the suction opening to the blower, in particular with the preferred arrangement of the electronics units in which the electronics unit with the smaller width is provided as the lower electronics unit.

According to a preferred embodiment, the combination appliance has an appliance housing in which the components of the hob and the components of the fume extraction device are jointly received. In particular, the blower, the filter unit, the fume extraction device electronics unit and the cooking modules of the hob and the hob electronics unit are received in the appliance housing. The cover plate of the hob may also be received in the appliance housing. In this case, the cover plate is received in the appliance housing such that this cover plate forms the upper side of the combination appliance and the cover plate additionally comprises the upper edge of the appliance housing. Alternatively, however, the cover plate may also be attached to the upper edge of the appliance housing or, respectively, the appliance housing may be fastened to the underside of the cover plate. Since the combination appliance has a common housing for the fume extraction device and the hob, the assembly of the combination appliance is simplified. In particular, the combination appliance may be assembled as a part in a worktop of a kitchen cabinet. Additionally, the common appliance housing also provides the simplification that an orientation of the components of the fume extraction device to the components of the hob is not required during assembly.

By means of the invention, therefore, a compact system is provided in which sufficient filtering is still able to be ensured. By means of the present invention, a combination appliance is provided which may have a small height and the storage space for the user at the bottom, for example a drawer, is not lost. Additionally, the combination appliance may be designed to have a width which is required for installation in standard kitchens, for example the combination appliance may have a width of 60 cm.

BRIEF DESCRIPTION OF THE DRAWINGS

The present invention is described again in more detail hereinafter with reference to the accompanying figures, in which.

DETAILED DESCRIPTION OF EXEMPLARY EMBODIMENTS OF THE PRESENT INVENTION

Figure 1:
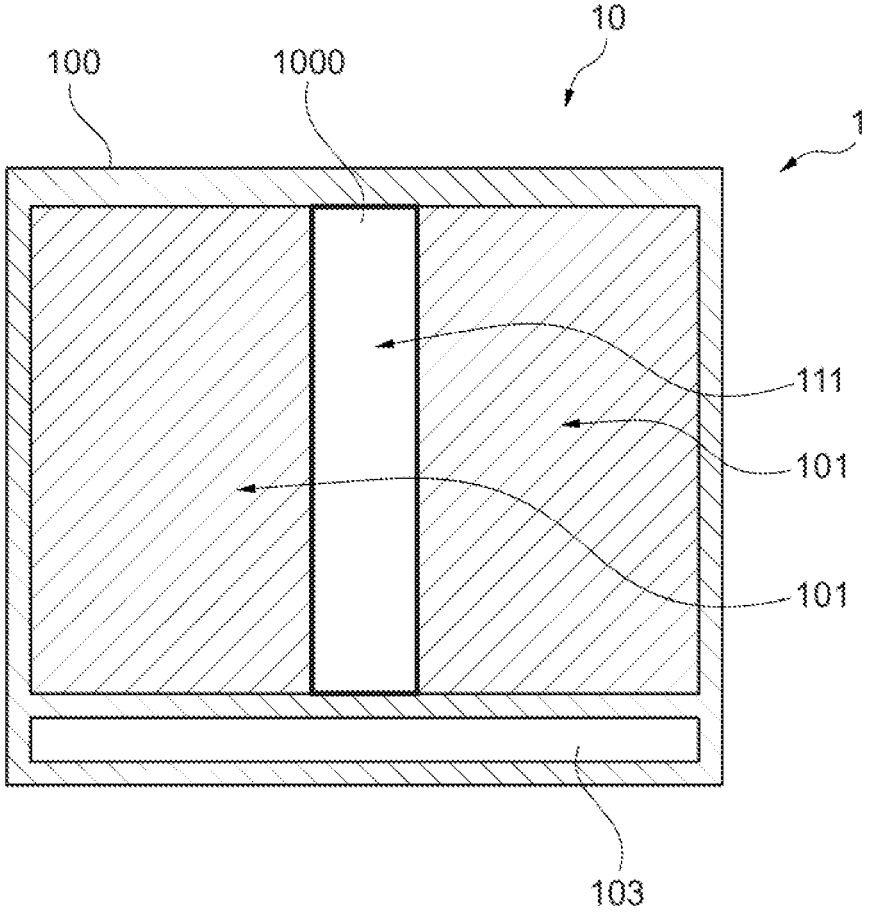
FIG. 1: shows a schematic plan view of a first embodiment of the combination appliance according to the invention.

A schematic plan view of an embodiment of the combination appliance 1 according to the invention is shown in FIG. 1. The combination appliance 1 consists of a hob 10 and a fume extraction device 11, only the suction opening 111 thereof being able to seen in FIG. 1.

The hob 10 consists of a cover plate 100 and cooking modules 101 arranged below the cover plate 100. In the embodiment shown, two cooking modules are provided. A cut-out 1000 which forms the suction opening 111 is incorporated in the cover plate 100. In the embodiment shown, the cut-out 1000 is incorporated in the center of the width of the cover plate 100 and extends in the depth direction. In the embodiment shown, the cut-out 1000 has a rectangular elongated shape. The length of the cut-out 1000, i.e. the dimension thereof in the depth direction, corresponds to the length of the cooking modules 101. The cooking modules 101 are arranged to the left and right of the cut-out 1000.

The cooking modules 101 are located below the cover plate 100 and are preferably fastened to the underside of the cover plate 100. Alternatively, the cooking modules 101 may also be held in a hob housing (not shown) and the cover plate 100 is thus applied to the hob housing such that the cooking modules 101 are located in the immediate vicinity or on the underside of the cover plate 100. If a hob housing is provided, said hob housing has a through-opening in the corresponding position of the cut-out 1000.

An operating unit 103 is arranged in the front region of the hob 10. In the embodiment shown, the operating unit 103 is arranged in front of the cut-out 1000 of the cover plate 100 and may comprise, for example, touch control elements, buttons or rotary knobs. Additionally, a display (not shown) may be contained in the operating unit 103. Depending on the design of the individual elements of the operating unit 103, this operating unit may be arranged inside and/or below the cover plate 100. At least the operating electronics (not shown) of the operating unit 103 are arranged below the cover plate 100.

Figure 2:
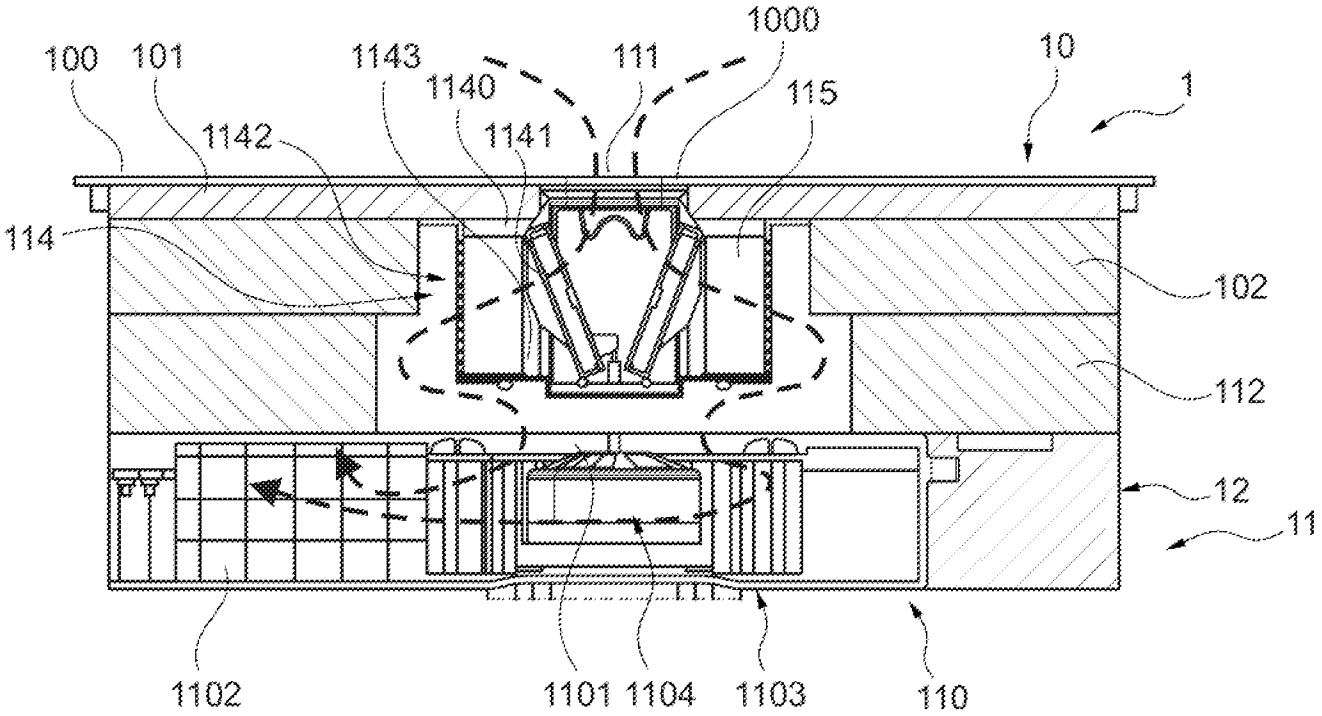
FIG. 2: shows a schematic sectional view of an embodiment of the combination appliance.

A schematic sectional view of an embodiment of the combination appliance 1 is shown in FIG. 2.

The combination appliance consists of the hob 10 and the fume extraction device 11. The combination appliance 1 has an appliance housing 12 in which the components of the fume extraction device 11 and the hob 10 are received. Two cooking modules 101 of the hob 10 are shown, said cooking modules bearing from below against the cover plate 100 of the hob 10 and also being able to be denoted as induction modules. A fastening element 1140 is provided in the cut-out 1000. This fastening element has a removable grille in the cut-out 1000 and extends on the underside of the cover plate 100 laterally beyond the cut-out 1000. The opening of the fastening element 1140, which is located in the cut-out 1000, forms the suction opening 111 of the fume extraction device 11. A filter unit 114 is arranged below the cut-out 1000 and thus the suction opening 111. The filter unit 114 has a grease filter 1141 and two odor filters 115. The construction of the filter unit 114 is described in more detail below with reference to FIGS. 3 to 6. A housing 1142 for receiving the filter unit 114 is fastened at the bottom to the fastening element 1140. The base of the housing 1142 represents a separating plate 1143.

The blower 110 of the fume extraction device 11 is arranged downwardly spaced apart from the separating plate 1143 on the base of the appliance housing 12. The blower 110 has a blower housing 1100 with an air inlet opening 1101 as well as an air outlet opening 1102 with a grille. The fan wheel 1103, which is driven via the motor 1104 is arranged in the blower housing 1100. The air inlet opening 1101 faces upwardly and the rotational axis of the fan wheel is located in the vertical direction and below the air inlet opening 1101.

Electronics units 102 and 112 are arranged above the blower 110 laterally adjacent to the filter unit. The upper electronics unit 102 represents the hob electronics unit and the lower electronics unit represents the fume extraction device electronics unit 112. The width of the hob electronics unit 102 is greater than the width of the fume extraction device electronics unit 112. Both electronics units 102, 112 are arranged such that they bear on one side against the appliance housing 12. Thus a shoulder is present on the opposing side of the electronics units 102, 112.

Figure 3:
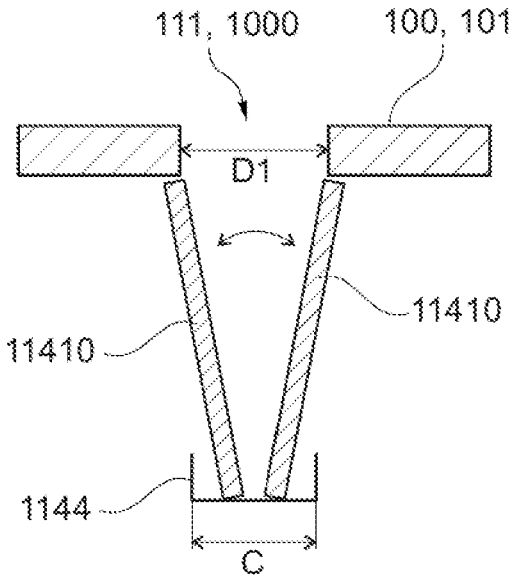
FIG. 3: shows a schematic sectional view of the hob in the region of the suction opening with the grease filter.

The suction opening 111 with the grease filter 1141 is shown schematically in FIG. 3. In this view, the suction opening 111 of the fume extraction device is formed by the cut-out 1000 in the cover plate 100 of the hob 10 or, respectively, between the cooking modules 101. The grease filter 1141 in this embodiment consists of two filter elements 11410 which are arranged inclined toward one another and form a V-shape. The undersides of the filter elements 11410 are held in a collection container 1144. The collection container 1144 in the embodiment shown represents an upwardly open rail. The suction opening 111 has a width D1 and the collection container 1144 has a width C. The width C is less than or equal to the width D1. The filter elements 11410 are pivotably fastened to the collection container 1144. As a result, as indicated in FIG. 3 by the double arrow, the grease filter 1141 may be folded up by folding up the filter elements 11410. In the folded-up state the grease filter 1141 may be removed upwardly through the suction opening 111.

Figure 4:
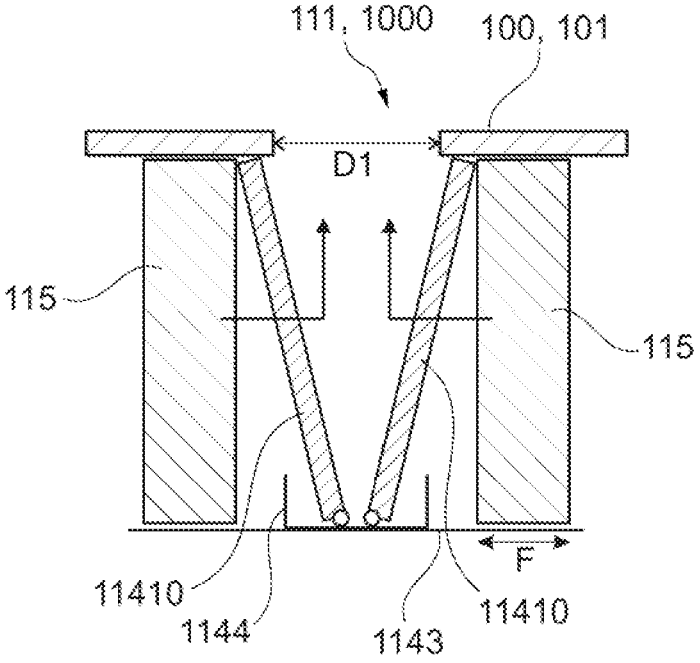
FIG. 4: shows a schematic sectional view of the hob in the region of the suction opening with the grease filter and odor filters.

A filter unit 114 with the filter element 114 and the two odor filters 115 are shown schematically in FIG. 4. The grease filter 114 has the construction described relative to FIG. 3. The pivotable mounting of the filter elements 11410 on the collection container 1144 is shown schematically in FIG. 4 by dots. The collection container 1144 and the odor filters 115 are positioned on the separating plate 1143. The odor filters 115 are arranged laterally adjacent to the grease filter 1141. In particular, on each side of the grease filter 1141 an odor filter 115 is offset to the side below the cover plate 100 for the cut-out 1000 which forms the suction opening 111. After the grease filter 1141 has been folded up and removed with the collection container 1144 via the suction opening 111, one of the odor filters 115 on the separating plate 1143 may be pushed in the direction of the suction opening 111 and removed through this suction opening. This is indicated in FIG. 4 by arrows. To this end, the thickness F of the odor filter 115 is less than the width of the cut-out 1000 and the suction opening 111.

Figure 5:
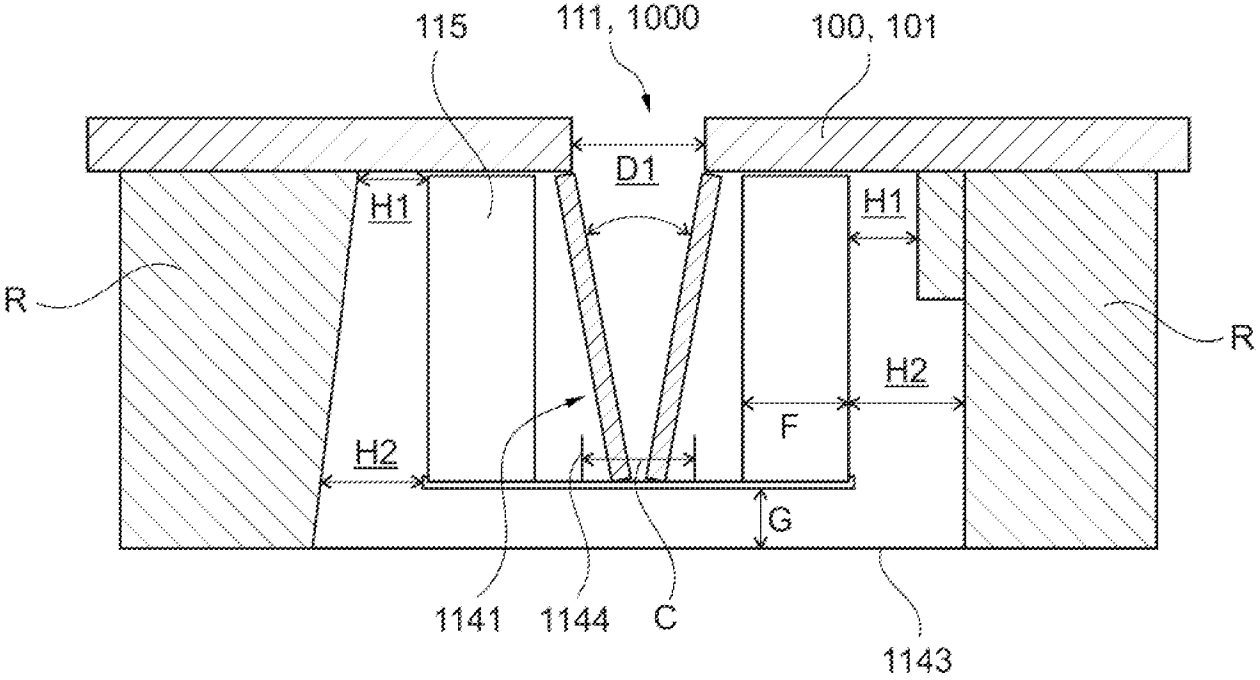
FIG. 5: shows a schematic sectional view of the upper region of the combination appliance.

The upper region of the combination appliance 1 is shown schematically in FIG. 5. In this case, the space R is indicated schematically for the arrangement of electronics units, not shown in FIG. 5. In particular, two variants are shown for the possibility of installing the electronics units. On the left-hand side an obliquely running partition wall is shown, relative to which electronics units may be installed to the left. On the right-hand side the space is shown such that in the upper region a wider electronics unit may be installed and in the lower region a narrower electronics unit may be installed. In both variants the spacing between the odor filters 115 or, respectively, the lateral ends of the separating plate 1143 in the lower region (H2) is greater than in the upper region (H1). Additionally, it is shown in FIG. 5 that a spacing G from the blower, not shown in FIG. 5, in particular the air inlet opening of the blower housing, is present below the separating plate 1143. In this spacing G, therefore, the airflow may be conducted from the odor filters 115 to the air inlet opening. The construction of the filter unit corresponds to the construction shown in FIG. 4 and thus is not described again.

Figure 6:
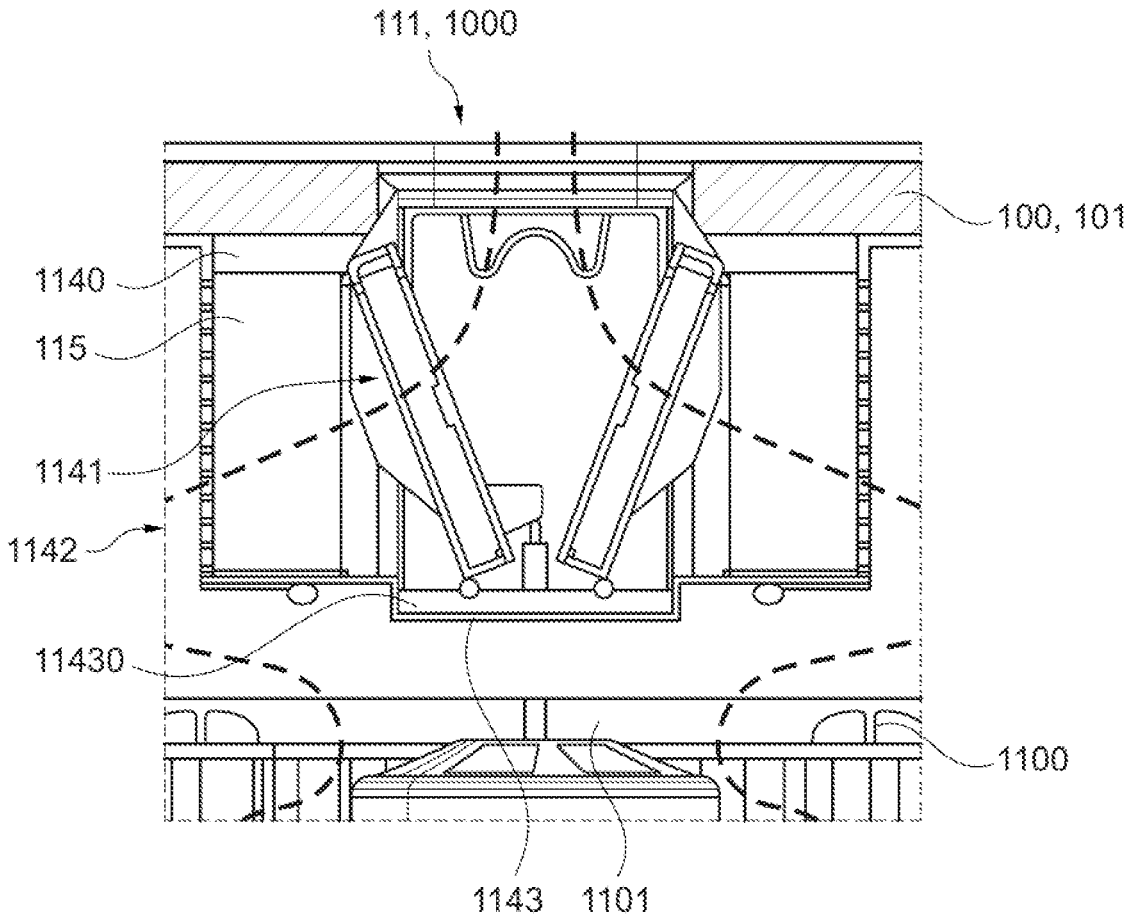
FIG. 6: shows a schematic sectional view of the filter unit of an embodiment of the combination appliance.

The filter unit 114 of the combination appliance 1 is shown again in detail in FIG. 6. Additionally, the airflow through the filter unit 114 and to the air inlet opening 101 is shown. Additionally, the housing 1142 for the filter unit 114 is shown in this FIG. 6. In the embodiment shown, the separating plate 1143 has a recess 11430 in the center. Additionally, in the embodiment shown the separating plate 1143 forms the base of the housing 1142 for the filter unit 114. The side walls of the housing 1142 in each case are formed by a grille.

Thus in the embodiment shown the airflow, which is shown schematically in FIG. 6, may enter through the suction opening 111, which is formed in FIG. 6 through an opening in the upper side of the fastening element 1140, into the fume extraction device 11. The air passes through the V-shaped grease filter 1141. The air which has passed through a filter element 11410 passes in the filter unit 114 to an odor filter 115 and passes through this odor filter. After exiting from the odor filter 115 to the side, the air is deflected downwardly and flows between the separating plate 1143 and the upper side of the blower housing 1100 to the air inlet opening 1101 of the blower housing 1100. From there, as shown in FIG. 2, the air is conducted via the fan wheel 1103 to the air outlet opening 1102 and leaves the fume extraction device 11 via said air outlet opening, and also the combination appliance 1 through an opening, not shown, in the appliance housing 12.

In the present invention, the grease filter is designed to be as large as possible in order to increase the efficiency of the filter and to minimize a flow resistance. In width, the suction opening is defined by the left-hand and right-hand modules. In length, the suction opening is designed to be as long as possible, ideally as long as the depth of the cooking modules. In height, the combination appliance is limited. In particular, the appliance should only be so large that the storage space located below, for example the drawer space, is only used up to a limited extent.

For this reason the grease filter preferably has a V-shape, wherein the filter is foldable. A sealed container, which may also be denoted as the collection container, is connected to the filter. The width of the collection container is less than the width of the suction opening, in particular the cut-out in the hob.

The odor filters are preferably mounted outside the foldable grease filter to the left and right thereof. The thickness of the odor filters F in this case is less than the width of the suction opening D1 in the hob. The length of the odor filter may correspond to the depth of the suction opening and is preferably less than the length of the odor filter. However, it is also within the scope of the invention that the odor filter has a greater length than the depth of the suction opening. In this case, the odor filter may be in multiple parts, wherein the individual parts are separately removed through the suction opening. The individual parts in each case have a length which is less than the depth of the suction opening.

The hob electronics, in particular the printed circuit boards, are generally arranged below the hob in order to gain space, and in the invention the electronics are preferably placed outside the airflow. The spacing H does not have to be necessarily equal over the entire height of the filter. It may be constructed such that H1<H2.

According to the invention, a separating plate ensures that the air flows through the grease filter and the odor filter and into the blower, which may also be denoted as the fan. A preferred spacing G>20 mm ensures that sufficient air passes to the fan wheel. The separating plate is preferably constructed such that it forms a trough. In the event that liquid flows in, the trough is preferably connected to a separate reservoir. Walls below the trough serve to prevent liquid dropping by capillary action into the air inlet opening and thus into the fan wheel and the motor.

A grille in the flow direction downstream of the odor filter preferably serves as a stop for the filter and ensures that the user is not able to reach into the motor.

According to the invention, a separate ventilation system is not installed below the hot plate but a complete combination appliance with both functions (cooking and ventilation) is provided. In this case, preferably only one housing is used.

REFERENCE CHARACTERS

1 Combination appliance
10 Hob
100 Cover plate
1000 Cut-out
101 Cooking module
102 Hob electronics unit
103 Operating unit
11 Fume extraction device
110 Blower
1100 Blower housing
1101 Air inlet opening
1102 Air outlet opening
1103 Fan wheel
1104 Motor
111 Suction opening for fume extraction device
112 Fume extraction device electronics unit
114 Filter unit
1140 Fastening element
1141 Grease filter
11410 Filter element
1142 Housing
1143 Separating plate
11430 Recess
1144 Collection container
115 Odor filter
12 Appliance housing
R Space for electronics units

The invention claimed is:

1. A combination appliance, comprising:
a hob including a cooking module and having a suction opening; and
a fume extraction device arranged, at least in part, below the cooking module in a vertical direction perpendicular to a plane of the cooking module, wherein the fume extraction device comprises:
a blower:
an air inlet opening;
a filter unit arranged at the suction opening and above the blower in the vertical direction, the filter unit having a grease filter; and
a separating plate arranged below the filter unit and above the blower in the vertical direction, the separating plate separating the filter unit from the blower.

2. The combination appliance of claim 1, wherein the separating plate has a recess comprising an upright edge.

3. The combination appliance of claim 1, wherein the separating plate is part of a housing for receiving the filter unit, said housing including a side wall configured as a grille.

4. The combination appliance of claim 1, wherein the grease filter is arranged in an inclined manner in the filter unit.

5. The combination appliance of claim 1, wherein the grease filter has a V-shaped configuration defining an open side which is oriented upwardly.

6. The combination appliance of claim 1, wherein the grease filter is foldable.

7. The combination appliance of claim 1, further comprising a collection container connected to the grease filter, said grease filter having an underside which is held in the collection container.

8. The combination appliance of claim 1, wherein the filter unit includes an odor filter which is arranged laterally adjacent to the grease filter in the filter unit.

9. The combination appliance of claim 8, wherein the odor filter is releasably held and has a thickness which is less than or equal to a width of the suction opening.

10. The combination appliance of claim 8, wherein the odor filter has a length which is greater than a length of the suction opening, said odor filter being configured in multiple parts.

11. The combination appliance of claim 1, further comprising a hob electronics unit and a fume extraction device electronics unit, with both the hob electronics unit and the fume extraction device electronics unit being arranged laterally relative to the filter unit above the blower.

12. The combination appliance of claim 11, wherein the hob electronics unit has a width which is greater than a width of the fume extraction device electronics unit, said hob electronics unit being arranged above the fume extraction device electronics unit.

13. The combination appliance of claim 1, further comprising an appliance housing configured to jointly receive the cooking module of the hob and the blower, the filter unit and the separating plate of the fume extraction device.

14. A combination appliance, comprising:

a hob including a cooking module and a suction opening; and a fume extraction device arranged, at least in part, below the cooking module in a vertical direction perpendicular to a plane of the cooking module, wherein the fume extraction device comprises:

an air inlet opening;

a filter unit arranged at the suction opening and comprising a grease filter;

a separating plate arranged below the filter unit in the vertical direction; and a blower arranged below the separating plate and the filter unit in the vertical direction.

15. The combination appliance of claim 14, further comprising an odor filter arranged outside of the grease filter in a lateral direction, wherein the lateral direction is parallel to the plane of the cooking module and perpendicular to the vertical direction.

16. The combination appliance of claim 15, wherein the separating plate and an air inlet opening of the blower are separated by a spacing.

17. The combination appliance of claim 16, wherein the blower creates suction which draws air through the suction opening, then through the grease filter, then through the odor filter, then around lateral ends of the separating plate, then through the spacing, and then into the blower.

18. The combination appliance of claim 14, wherein a diameter of the grease filter is less than a diameter of the suction opening such that the grease filter is insertable through the suction opening.

19. The combination appliance of claim 15, wherein the grease filter and the odor filter extend vertically downward and away from the suction opening such that the grease filter and the odor filter do not block the suction opening.

* * * * *